US011268681B2

(12) United States Patent
Le Bourhis et al.

(10) Patent No.: US 11,268,681 B2
(45) Date of Patent: Mar. 8, 2022

(54) LOAD BALANCING DEVICE FOR IMPROVING THE HOLDING OF A HEADLAMP ON THE HEAD OF A USER

(71) Applicant: Zedel, Crolles (FR)

(72) Inventors: Mathieu Le Bourhis, Saint Hilaire (FR); Boris Bouffay, Saint Hilaire du Touvet (FR); Philippe Berrel, La Chapelle du Bard (FR)

(73) Assignee: Zedel S.A.S., Crolles (FR)

( * ) Notice: Subject to any disclaimer, the term of this patent is extended or adjusted under 35 U.S.C. 154(b) by 0 days.

(21) Appl. No.: 16/731,570

(22) Filed: Dec. 31, 2019

(65) Prior Publication Data

US 2020/0208818 A1 Jul. 2, 2020

(30) Foreign Application Priority Data

Dec. 31, 2018 (FR) ..... 1874422

(51) Int. Cl.

| | |
|---|---|
| ***F21V 21/30*** | (2006.01) |
| ***A42B 1/244*** | (2021.01) |
| ***F21V 21/084*** | (2006.01) |
| ***F21V 21/14*** | (2006.01) |
| ***A42B 3/14*** | (2006.01) |

(52) U.S. Cl.

CPC ..... *F21V 21/30* (2013.01); *A42B 1/244* (2013.01); *F21V 21/084* (2013.01); *F21V 21/145* (2013.01); *A42B 3/142* (2013.01)

(58) Field of Classification Search

CPC ..... F21V 21/30; F21V 21/084; F21V 21/145; A42B 1/244; A42B 3/142

USPC ..... 362/105

See application file for complete search history.

(56) References Cited

U.S. PATENT DOCUMENTS

| | | | | |
|---|---|---|---|---|
| 2,176,789 | A * | 10/1939 | Capitani | F21L 15/14 362/105 |
| 5,115,382 | A | 5/1992 | Smith | |
| 7,370,991 | B1 | 5/2008 | Ellis-Fant | |
| 2009/0323317 | A1* | 12/2009 | Spartano | F21V 23/0414 362/105 |

FOREIGN PATENT DOCUMENTS

| | | |
|---|---|---|
| EP | 2 562 825 | 6/2012 |
| EP | 3 290 785 | 5/2019 |
| FR | 2 828 553 | 2/2003 |
| FR | 3 47 570 | 8/2017 |

* cited by examiner

*Primary Examiner* — Andrew J Coughlin
*Assistant Examiner* — Jessica M Apenteng
(74) *Attorney, Agent, or Firm* — Saile Ackerman LLC; Stephen B. Ackerman

(57) ABSTRACT

A headlamp with—a headband; a light source located at the front of the headband is presented. The headlamp has a load balancing device with two strands. The first strand has a first end (A) and a second end (B) respectively attached on one left front fixing point and one left rear fixing point of said headband. The second strand has a first end (A') and a second end (B') respectively attached on one right front fixing point and one right rear fixing point of said headband. There is an element wherein the first and second strands are thread up so as to bring closer the two strands at one common point C.

11 Claims, 14 Drawing Sheets

LOAD BALANCING DEVICE FOR IMPROVING THE HOLDING OF A HEADLAMP ON THE HEAD OF A USER

TECHNICAL FIELD

The present invention relates to headlamps and in particular a holding device for a headlamp band.

BACKGROUND ART

Headlamps, such as those originally used by miners, are subject to a great success in the field of leisure activities, including caving and hiking. They are also widely used professionally.

In general, they are destined to develop in all human activity in a contemporary society that wants to be more and more nomadic.

The more recent headlamps feature a high-powered light source at the front and a high-power battery pack located at the back.

As a result of this configuration, there is a problem of balancing the loads and comfort for the user that the support strip must make it possible to adjust the better.

There are multiple solutions to ensure such balancing of loads.

FIG. 1 illustrates a first type of known headband, manufactured by the Applicant of the present application, for ensuring the attachment to the head of a user of a headlamp with a large enough battery attached to the belt.

FIG. 2 illustrates a second example of a rather bulky attachment device comprising several fastening strips, as described in EP2462825, allowing the attachment of a protective helmet or a welding mask to the head of a user.

FIG. 3 illustrates another example of a fastening system, as described in French patent FR3047570 allowing the attachment of glasses These are some examples of fastening system on the head of a user that are not necessarily adapted to the most recent criteria of functionality, aesthetics and lightness.

It is proposed to remedy this situation, by providing a headband for a headlamp which shows to be perfectly balanced, simple and quick to adjust on the head of a user, and a great aesthetic.

SUMMARY

The present invention aims to provide a headlamp with a new type of rigid/semi-rigid band allowing wide possibilities adjustment on various user heads.

Another object of the present invention is to provide a headlamp with a light-weight headband and a system for balancing loads between the weight of the lamp and that—more important—of the power battery.

It is a third object of the present invention to provide a headlamp with a removable balancing attachment to enhance the comfort of the lamp even during the most extreme activities.

These and other objects of the invention are achieved by means of a headband, a light source situated at the front of said headband, a battery situated at the rear of said headband and a load balancing device. The load balancing device comprises:

- a first strand comprising a first end (A) and a second end (B) respectively attached on one left front fixing point and one left rear fixing point of the headband;

- a second strand comprising a first end (A') and a second end (B') respectively attached on one right front fixing point and one right rear fixing point of the headband;
- one element wherein are thread up the first and second strands so as to bring closer the two strands at one common point C.

In one particular embodiment, the fixing points are movable, e.g. by means of clips.

Preferably, the first ends (A, A') of said first and second strands (200, 300) are fastened via a sliding element so as to move the position of points A and A' on the headband.

In one particular embodiment, the second ends (B, B') of said first and second strands (200, 300) are located at one common fixing point situated close to the battery at the rear of the headband.

Preferably, the headband is a structure having a constant length, and being symmetrical with respect to a median sagittal plane, and further comprising an alteration of rigid/semi-rigid elements so as to allow a deformation in the space and an adjustment on the head of a user.

In one particular embodiment, the headband is a rigid/semi rigid headband comprising:

- a rigid/semi-rigid front section allowing a certain deformability along a first plane (x, y);
- a rigid/semi-rigid intermediate section allowing a certain deformability along a second plane (x, z);
- a rigid/semi-rigid rear section allowing a certain deformability along a third plane (y, z);

wherein said headband comprises elements configured for the attachment and the passage of an elastic link for constraining the deformation of the rigid/semi rigid headband within the three planes.

The invention is particularly suitable for the realization of a compact headlamp which comprises one light module at the front and one weighty rear battery pack at the back.

BRIEF DESCRIPTION OF THE DRAWINGS

Other features of one or more embodiments of the invention will appear from the following description of embodiments of the invention, with reference being made to the accompanying drawings.

DESCRIPTION

On will now describe a load balancing structure and device which is perfectly adapted to the realization of a headlamp based on a rigid/semi-rigid supporting structure that is particularly easy to adjust, allowing a perfect holding of the lamp even when the latter includes, in particular, a quite significant heavy battery pack at the rear. It should be noted that the device may also be advantageous in the case of a remote battery pack to allow the balancing of loads and weights when the headband structure supports a lamp frontal which is particularly heavy and which tends to destabilize the headlamp to the front. Therefore, the embodiments that will be described later provide a significant solution for re-balancing loads that are present either at the front or at the back of the headband structure.

Although the balancing structure described below can be used for any type of headlamp, and any type of headband, elastic or not, we will describe more specifically the device in relation to a specific headlamp, such as described in European Patent Application EP3290785, entitled "Lamp with a rigid or semi-rigid band", filed on 28 Aug. 2017 by the applicant of the present application, which allows the realization of a light headlamp, well balanced and perfectly aesthetic.

One recalls the general structure of a rigid/semi-rigid headband structure in relation with FIGS. 4A-4D, while a first simplified embodiment will be more specifically described in connection with FIGS. 5A-5D.

This new type of headlamp features a rigid/semi-rigid headband structure coming to achieve a "break" with respect to conventional elastic bands, bringing a new aesthetics but also new possibilities of a fast—almost immediate—adjustment of the headband on the user's head. This headlamp uses this effect a specific headband showing a combination of rigid/semi-rigid sections of constant length and belonging to a family of forms three-dimensional shapes capable of deforming in space in several planes.

More specifically, the headband structure comprises:

a rigid/semi-rigid front section allowing a certain deformability along a first plane (x, y) which is a transverse plane;

a rigid/semi-rigid intermediate section allowing a certain deformability along a second plane (x, z) which is a sagittal plane;

a rigid/semi-rigid rear section allowing a certain deformability along a third plane (y, z) which is a frontal plane.

The three-dimensional shape of this headband allows it to keep a constant length, while allowing deformations according to the three planes, thus allowing the headband structure to conform to the shape of a user's head.

Figure 1:
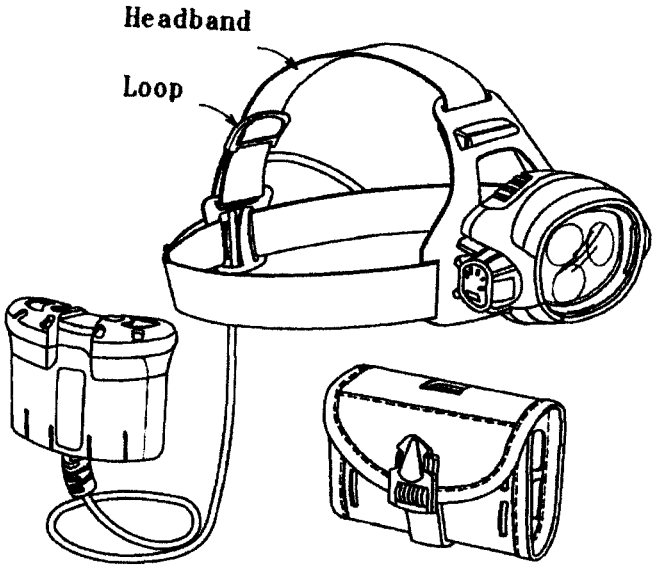
FIGS. 1, 2 and 3 illustrate three examples of devices for maintaining a headlamp or other electronic device on the head of a user.
Figure 2:
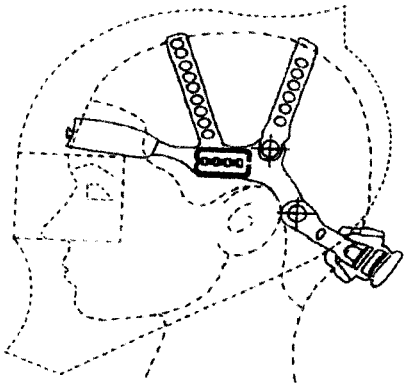
Figure 3:
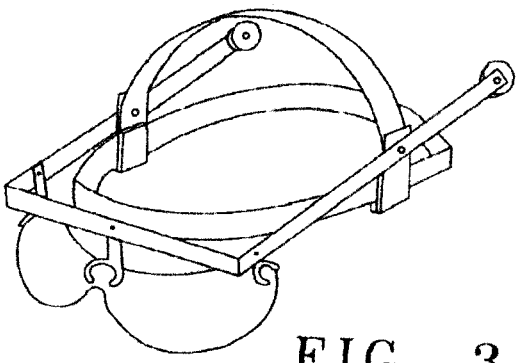
Figure 4A:
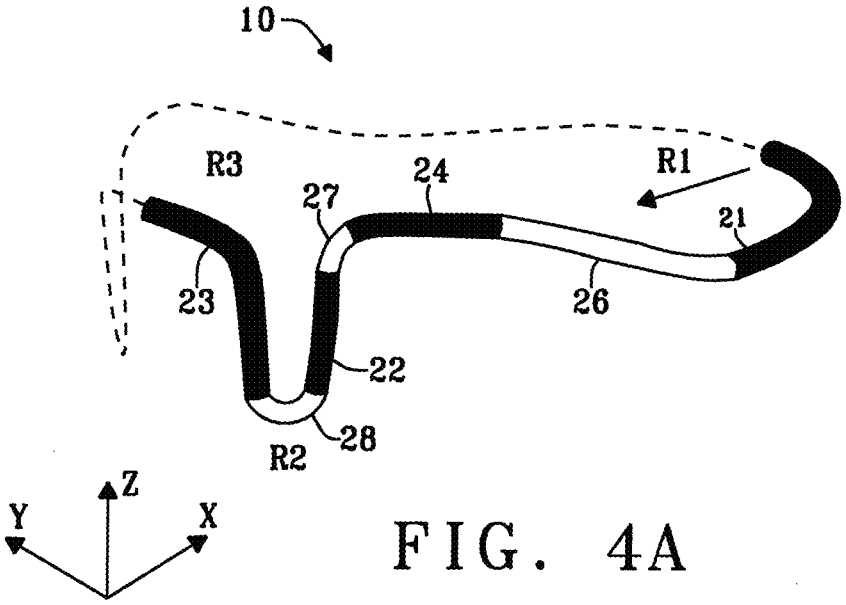
FIGS. 4A-4D illustrate the structural principle of a semi rigid/rigid strip known, having a specific headband with a front element and three semi-rigid side elements allowing deformation in three planes xz, xy and yz.

Referring more specifically to the diagram of FIG. 4A, we see that the three-dimensional structure of a headband 10 more specifically comprises an alternation of rigid and semi-rigid (deformable) elements. The rigid elements are illustrated in the clear in the figure while the semi-rigid (deformable) elements are shown in dark. As it can be seen, the headband 10 of FIG. 4A comprises a right branch with a deformable semi-rigid front section 21 then, from right to left:

a rigid lateral section 26 (clear),
a semi-rigid lateral section 24 (dark),
a rigid lateral section 27 (clear),
a semi-rigid lateral section 22 (dark),
a rigid lateral section 28 (clear),
a semi-rigid rear section 23 (dark).

The front section 21, the lateral sections 24 and 22, and the rear section 23 which are all semi-rigid, allow the deformation of headband of constant length in the three planes (x, y), (x, z) and (y, z), thus causing the variability of the radii of curvatures R1, R2 and R3 enabling the attachment of the headband 10 to head of any shape and size.

Figure 4B:
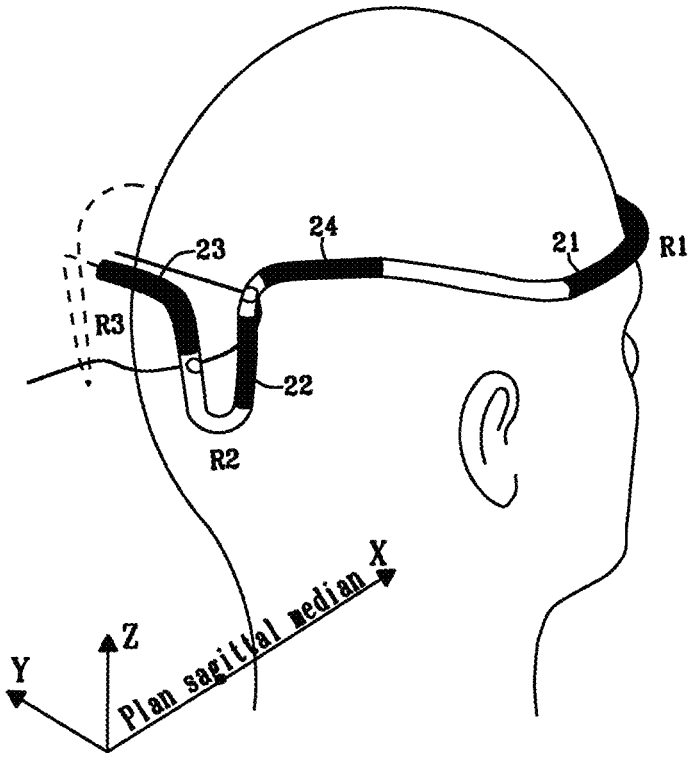
Figure 4C:
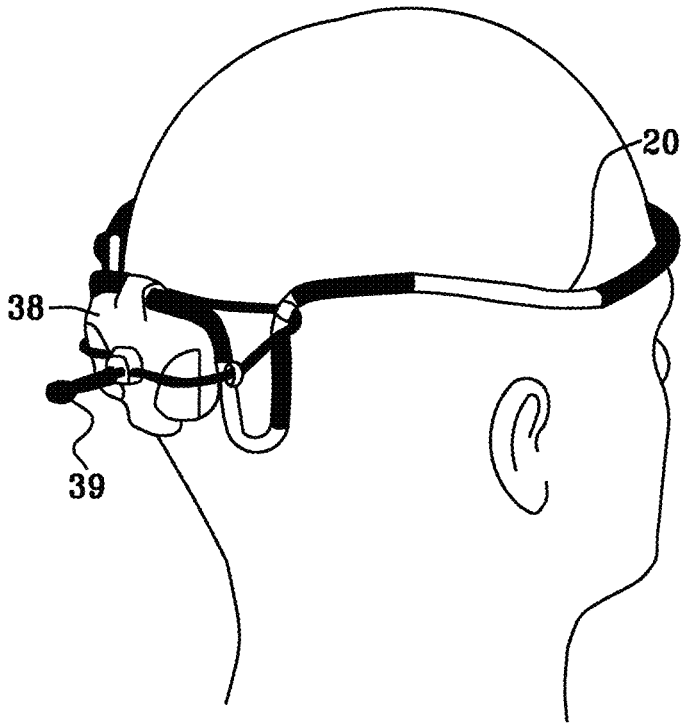
Figure 4D:
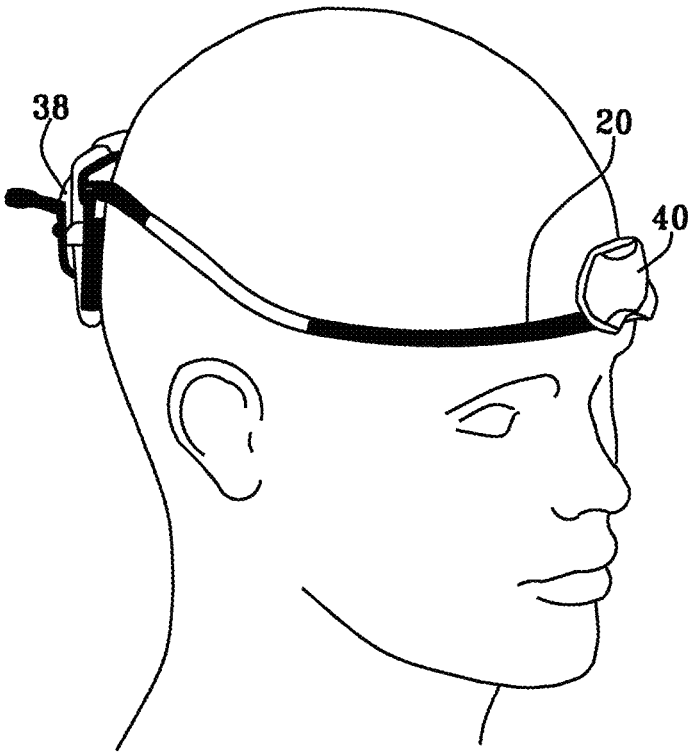

FIG. 4B illustrates the positioning of the headband structure on the head of a user, without the lamp power supply battery, while FIG. 4C shows the headband structure with a battery pack 38 located at the back, as well as a device for fixing 39 of the clamping elastic. FIG. 4*d* illustrates a perspective before same band illustrated in FIGS. 4A-4C, where we see the lamp distinctively 40 at the front and the battery 38 in the rear position.

Figure 5A:
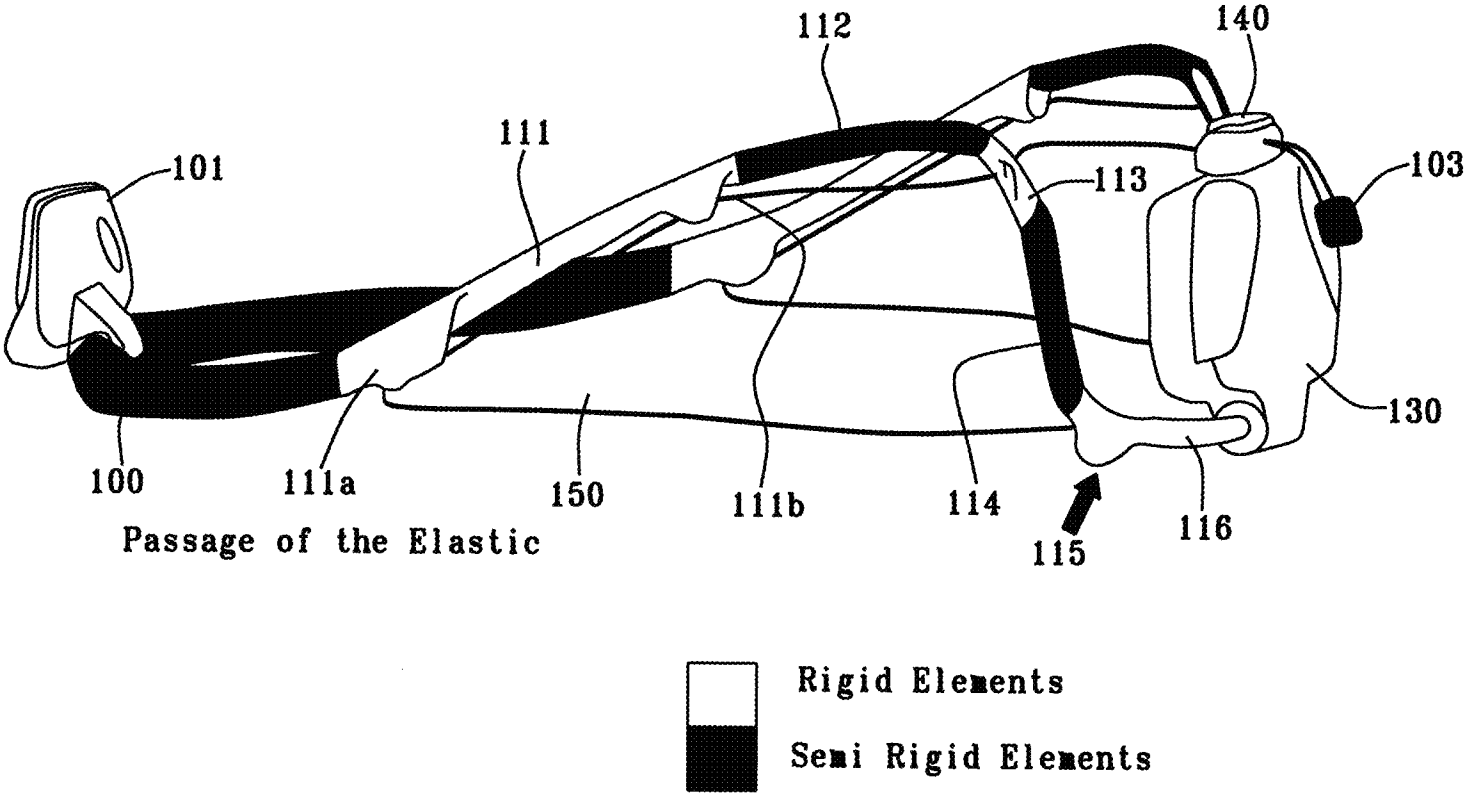
FIGS. 5A-5C illustrate more specifically one embodiment simplification of a known rigid/semi-rigid strip, as described in the applications for European patent EP3290785.
Figure 5B:
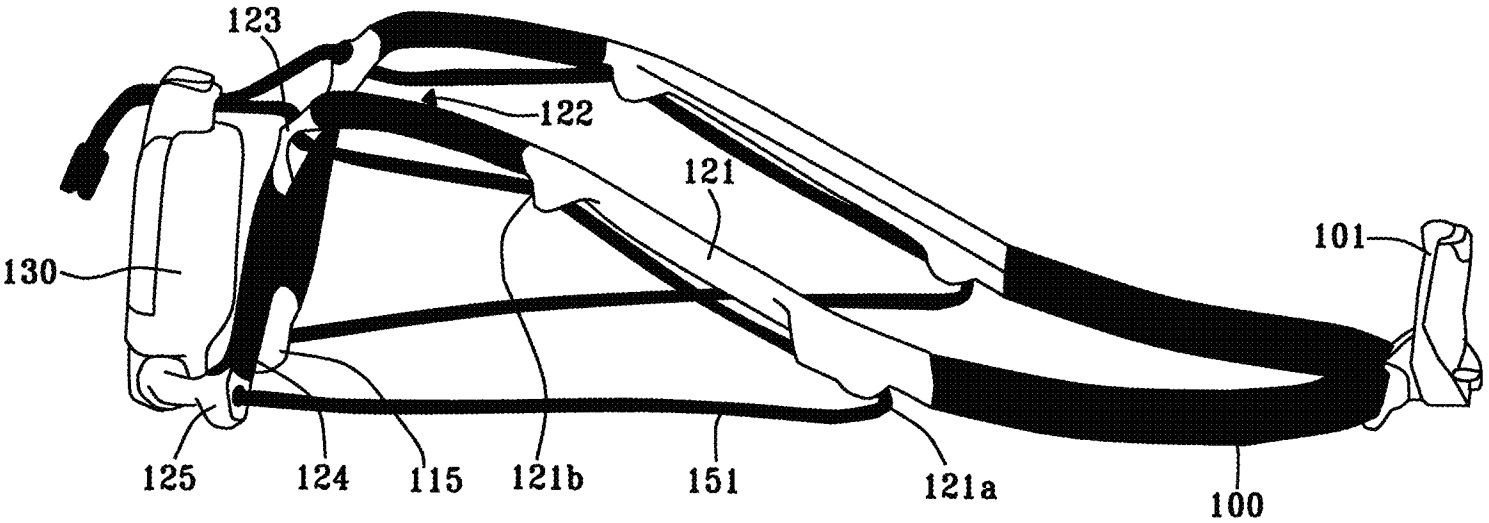

FIGS. 5A and 5B show more specifically the detail of a first simplified embodiment of a strip 50 comprising an alternation deformable semi-rigid elements (in dark) and rigid elements (in clear), allowing the deformation of the band at constant length in the three planes (x, Y), (x, z) and (y, z) and the variability of the curvature angles R1, R2 and R3, respectively.

FIG. 5A shows more specifically the left branch of the first embodiment which comprises a semi-rigid front section 100, on which is fixed a rigid piece called "platinum" serving as a base or support, via a pivot, to a lamp 101 having one or more LEDs associated with a system optical and a corresponding electronic circuit. The front part can be extruded.

The device further comprises a rigid (clear) rear section 116 forming a rear part of the headband. Alternatively, element 116 can become semi-rigid to fit on the xy plane.

The headband has, on its left branch, a first rigid element 111 (of greater rigidity than the semi-rigid element (100)) having a first lower end fixed to a first end of the front section 100, and a second upper end attached to a second semi-rigid element 112 (dark, therefore more flexible). The rigid element 111 comprises, respectively at its two lower and upper ends, two traversing holes 111*a* and 111*b* which are configured for receiving a first tightening elastic link 150.

The second semi-rigid element 112 has a first end fixed to the second end of first element 111 and a second end fixed to a first end of a third rigid element 113 serving as a point of passage for the elastic link 150 coming from the second element 111*b* belonging to the left branch.

The headband further comprises a fourth flexible (semi-rigid) element 114 having a first upper end fixed to a second end of the third element 113 and a second end fixed to a rigid fifth element 115 allowing the fastening of the first elastic link 150 coming from the traversing hole 111*a*.

The left branch of the headband is finally fastened to a first end of the rigid or semi-rigid element 116 forming the rear part of the rigid/semi-rigid headband structure, via a second end of the rigid element 115. According to the embodiment being considered, the rear section 116 may be rigid or semi-rigid so that the elements 115 and 116 may be of a same manufacturing process. When the rear section 116 is semi-rigid (dark), then the rigid fifth element 115 will be distinct from the latter. On the contrary, if the rear section 116 is rigid, the elements 115 and 116 may be identical or resulting from a same manufacturing process.

FIG. 5*b* illustrates the detail of the right branch of the headband structure which, as can be seen, is perfectly symmetrical with respect to the left branch. We see in the FIG. 5*d* that the right branch comprises a sixth rigid element 121 having a first lower end attached to a second end of the front section 100 as well as a second upper end attached to a first end of a seventh flexible element (semi-rigid) 122. The rigid element 121 comprises, at its two lower and upper ends respectively, two traversing holes 121*a* and 121*b* for receiving a second tightening elastic link 151.

The flexible element 122 has a first end attached to the element 121 and a second end fixed to an eighth rigid element 123 serving as a point of passage for the elastic link 151 coming from the element 121*b* of the right branch.

The headband then comprises a ninth flexible (semi-rigid) element 124 having a first upper end fixed to a second end of the element 123 and a second lower end located at a first end of a tenth rigid element 125 and allowing the fastening of the second elastic link 151 coming from the passage hole 121*b*.

The right branch of the head band is finally attached to the rear (semi-rigid) section 116 which forms the rear of the rigid/semi-rigid headband via a second end of the rigid element 125.

As seen in the figure, the rigid element 121 comprises, at its two ends 121*a* and 121*b*, the passage holes which are configured to receive the elastic link 151 allowing the strain on the radius of curvature R2 and, consequently, the deformation of the headband within the sagittal plane (x, z).

Figure 5C:
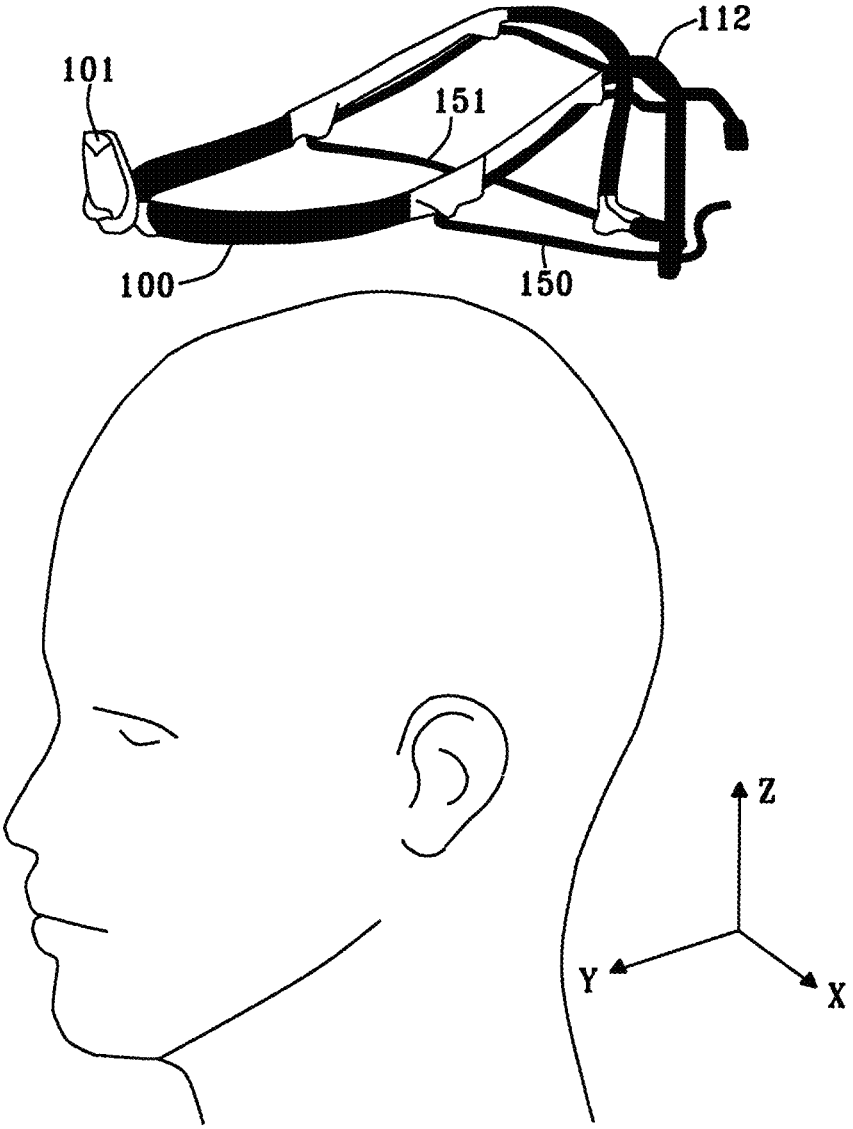

FIG. 5C shows the positioning of the rigid/semi-rigid headband structure on the head of a user with, highlighted, the role of the fastening elastic links 150 and 151, making it possible to constrain the deformation of the following rigid/semi-rigid headband within the three planes, reducing the radii of curvature R1-R3 and finally adjust the headband on the head of a user.

This first embodiment of a rigid/semi-rigid strip, illustrated in detail in FIGS. 5A and 5B, is perfectly suitable for producing a light headlamp capable of holding in place a lamp 101 located at a distance of before and, at the rear, a battery pack 130 quite voluminous.

The technological features of headlamps today are such that there is a tendency to associate LED light sources relatively light—but nevertheless with a high brightness—with a relatively heavy battery supply. Thus, there is a significant difference in weight between the weight of the lamp 101 at the front of the headband structure and that of the battery 130 disposed at the rear.

This results in a fairly large imbalance that can be a source of discomfort for the user, especially in certain situations of intense movement, for instance when the user is running.

Figure 6:
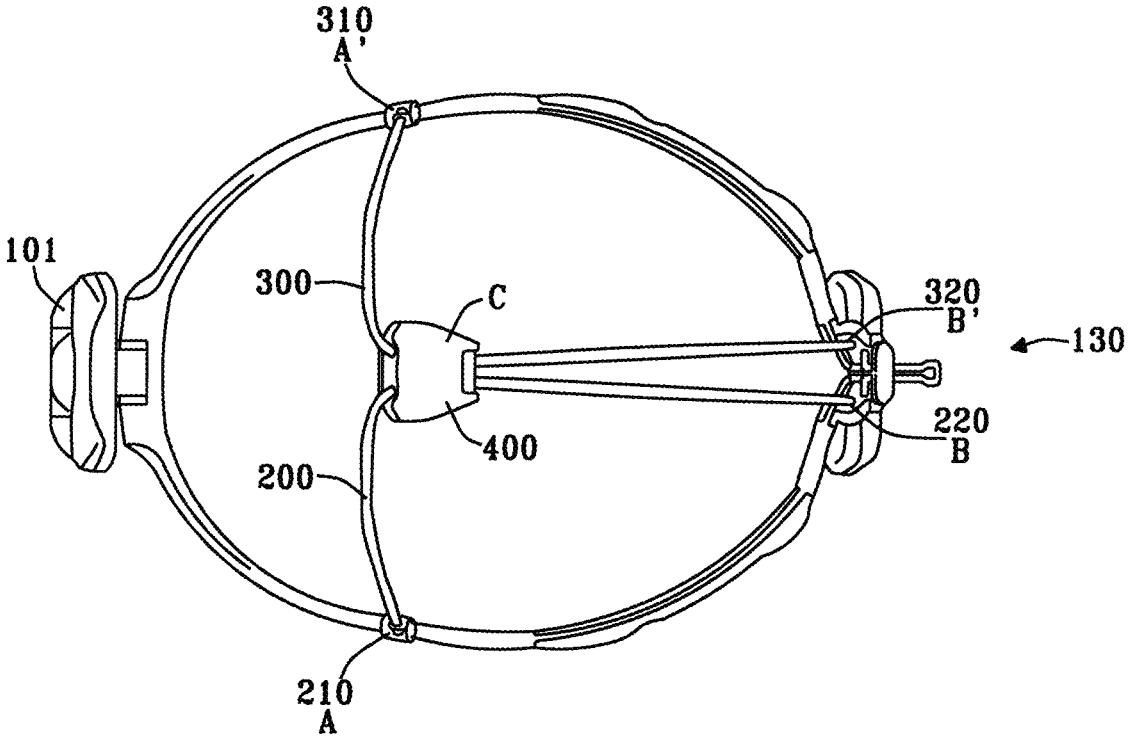
FIG. 6 illustrates a view from above of a first embodiment a rigid/semi-rigid strip with a device for balancing loads.

In order to significantly increase the feeling of comfort for the user, but also the balancing of the headlamp on his head, the rigid/semi-rigid headband structure is equipped, as will now be seen with FIG. 6 and following, with an improved balancing device which is perfectly adapted to the type of rigid/semi-rigid headband structure but which can also be installed on any type of more conventional headband.

FIG. 6 illustrates a top view of a first preferred embodiment of a rigid/semi-rigid headband structure fitted with a load balancing device.

The device comprises two strands 200 and 300, non-extensible, each having a first end (respectively 210, 310) and a second end (respectively 220, 320).

The first end 210 (point A) of the strand 200 is fixed on a front portion of the left branch of the headband while the second end 220 (point B) of the strand 200 is attached to a rear element of the headband. Similarly, the first end 310 (point A') of strand 300 is fixed on a front portion of the right branch of the headband structure while the second end 320 (point B') of the strand 300 is attached to a rear member of the headband structure.

In a particular embodiment, the fixing points A, B, A' and B' may be permanent or removable, for example by clipping, knot etc. . . . .

Alternatively, the headband structure may be configured to provide a plurality of clipping positions for fixing strands 200 and 300 at several possible locations.

Moreover, the two strands are threaded inside an element 400, preferably sliding, making it possible to form a junction C between the two strands 200 and 300. The sliding element 400 may be made of any material (plastic, metal, textile) of various shapes (ring, textile). In a particular embodiment, the sliding element may consist of two pulleys whose axes are parallel and substantially vertical.

Figure 7A:
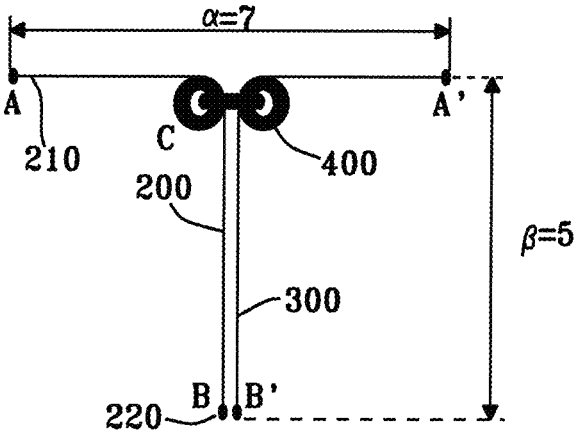
FIGS. 7A and 7B illustrate the operating principle of the balancing device.

FIGS. 7A and 76 illustrate the principle of operation of the balancing device based on the sliding element 400 which makes it possible to bring the two strands 200 and 300 closer together at a point C. It will also be observed that the ends B and B' are close, while that the ends A and A' are relatively distant.

Figure 7B:
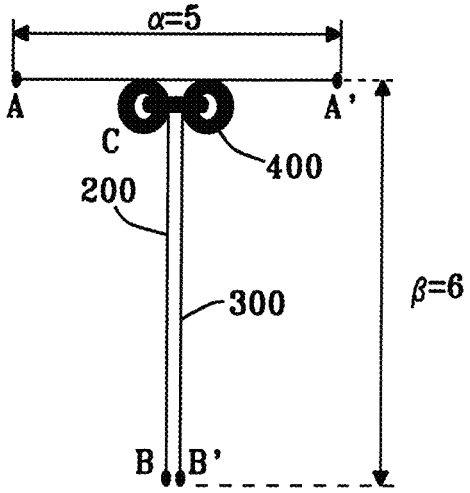
Figure 8A:
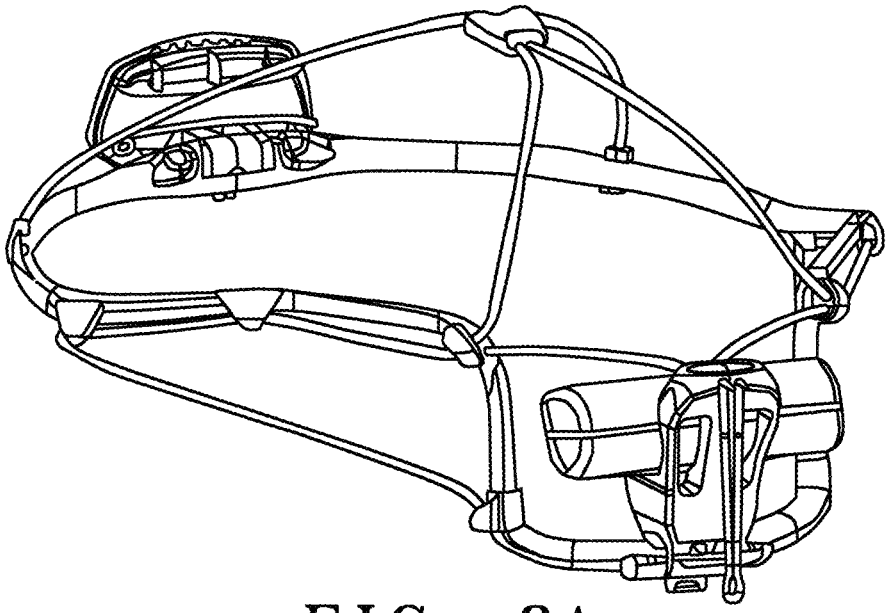
FIGS. 8A-8E illustrate different views and perspective, of a second mode of making a more sophisticated rigid/semi-rigid strip, fitted with the load balancing device of FIG. 6, allowing the support of a rear battery having a significant weight.
Figure 8B:
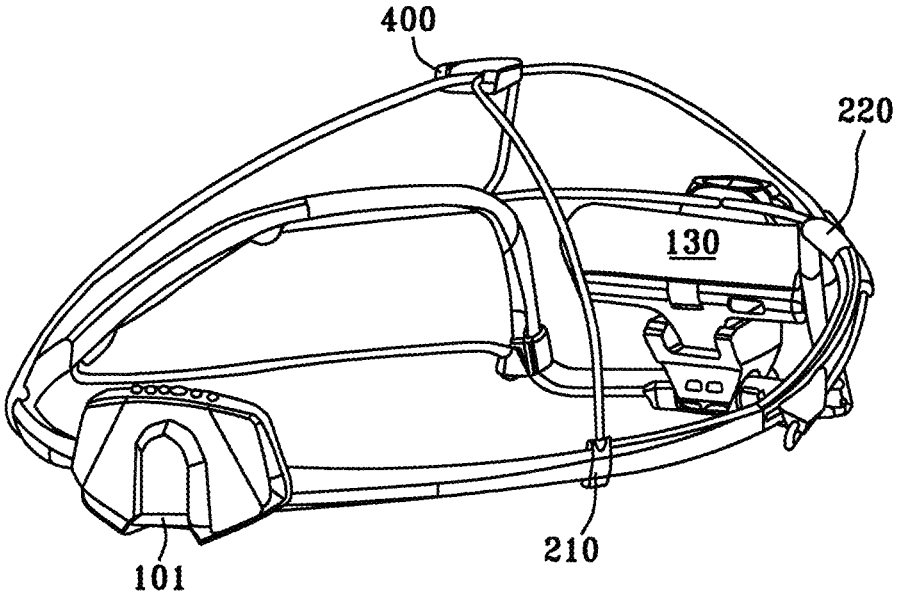
Figure 8C:
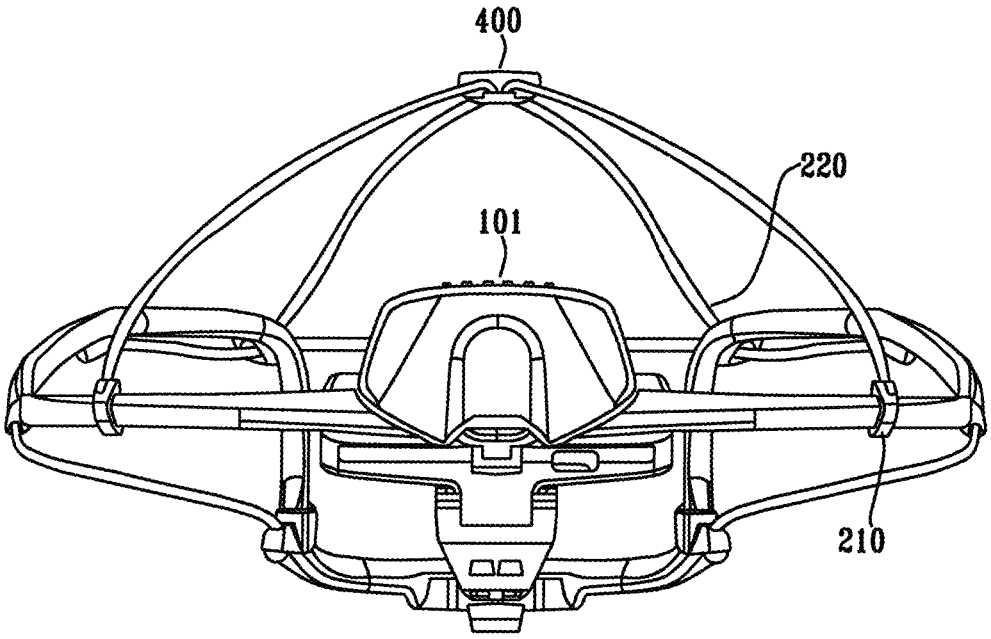
Figure 8D:
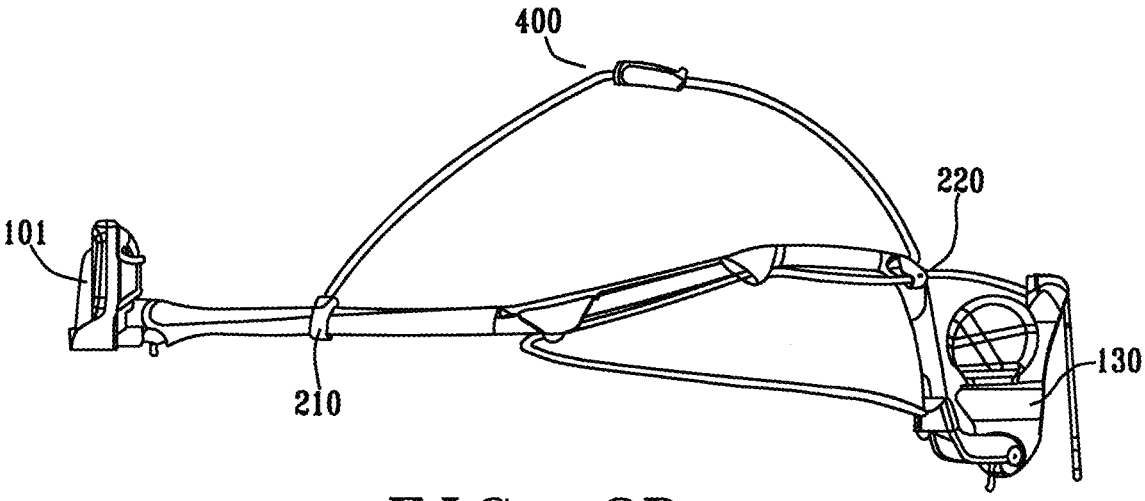
Figure 8E:
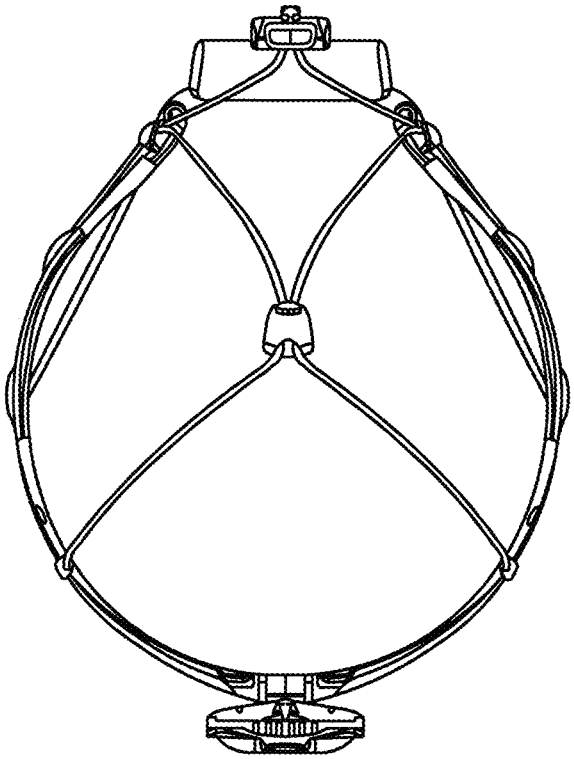

As seen in FIGS. 7A and 7B, if the strands AB and A'B' are placed so that each forms a right angle (at the accuracy near the pulley), then for an additional displacement unit on the segment β, two units are lost on the a segment. It can therefore be seen that the sliding of the sliding element 400—such as a slider—contributes to the clamping or, conversely, to the loosening of the right and left branches of the rigid/semi-rigid strip, thus advantageously cooperating with the tightening already possible via elastics links 150 and 151.

This results in a double technical effect, namely a complementary adjustment of the headband structure on the head of the user and also the establishment of an additional holding effect carried out by element 400 in combination with the two strands resting on the head of the user.

This ensures a better disposition of the loads, even when the respective weights of the light source 101 and the battery 130 show to be quite different.

In particular embodiments, one will choose strands 200 and 300 slightly elastic, wide enough to provide comfort for the user, and thin enough not to excessively increase the weight of the headband. The sliding element 400 may be made of injected plastic with a shape designed for the comfort of the user, in particular exposing large surfaces refined and curved for optimal contact with the user's head.

In one particular embodiment, sliding element 400 is fitted with a mechanism for tightening the strands 200 and 300, what improves more the possibilities of adjustment of the headband structure on a user's head. Ends A, B, A' and B' are fixed on the headband structure through fastening elements 210, 220, 310 and 320 which are either fixed or removable, such as clips for instance, so that the load balancing device based on sliding element 400 can itself become an removable accessory, useful for certain activities. Moreover, when the user is considering the use of its headlamp in some "statical" activity, the headlamp may be used in its single configuration without the accessory load balancing device, as represented in FIGS. 5A and 5B. On the contrary, should the user consider a more "dynamic" activity, e.g. long distance running, he will find an significant advantage in the use of the load balancing device based on the two strands 200 and 300 combined with sliding element 400.

Further alternative may be considered for the possible locations of attachment points A, B, A' and B'. In one particular embodiment, one may locate the attachment points on the rigid sections composing the rigid/semi-rigid headband structure. Alternatively, the attachment points may be arranged on the semi-rigid sections.

FIGS. 8A, 8B, 8C, 8D and 8E illustrate several perspective views of a second—more sophisticated—embodiment of a rigid/semi-rigid headband structure, comprising attachment points A and A' which are respectively arranged on the front section, while the two attachment points B and B' are arranged on elements 113 and 123 of the left and right branch of the headband structure.

Preferably, the attachment points are configured with clips which are located in one or more slots arranged on the lateral side of the headband so as to allow an adjustable fixing. Alternatively, the attachment points can be based on "sliders" configured on the left and right branches of the headband structure, therefore allowing an easy moving of the attachment point on the headband structure.

Figure 9:
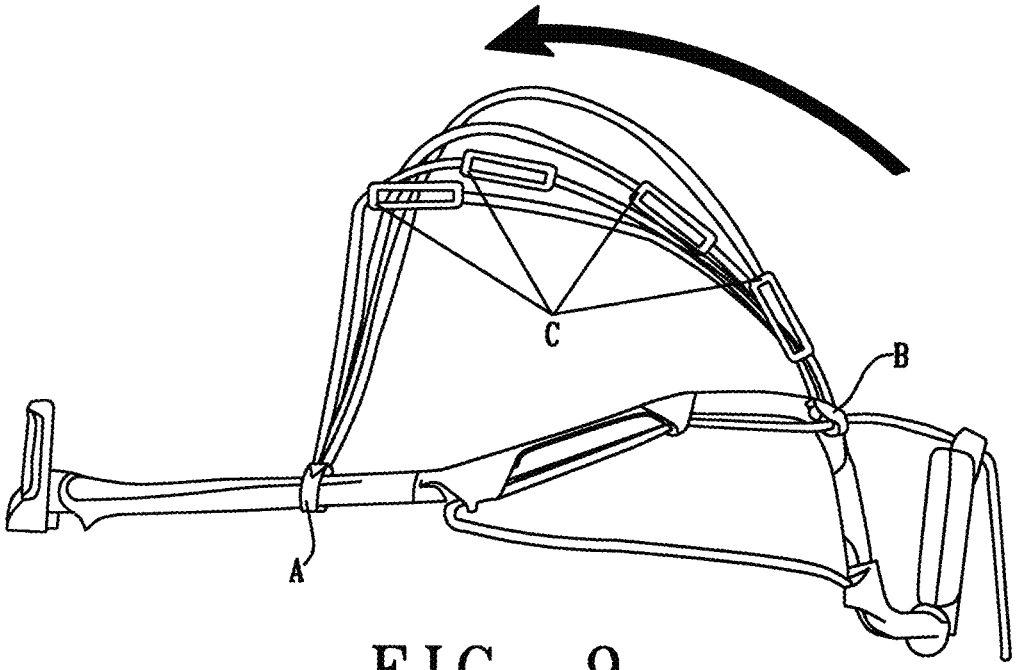
FIG. 9 illustrates several possible settings of the balancing device of the embodiment of FIG. 8.

FIG. 9 illustrates different possibilities of adjustments of the Headband structure on the user's head, as the sliding element 400 (point C) is moved along the later size of the structure. As can be seen, according to the position of point C, strands 200 and 300 progressively comes to correspond to the shape of the head. The efforts are then applied on the top of the head, increasing comfort and stability of the headlamp.

Figure 10:
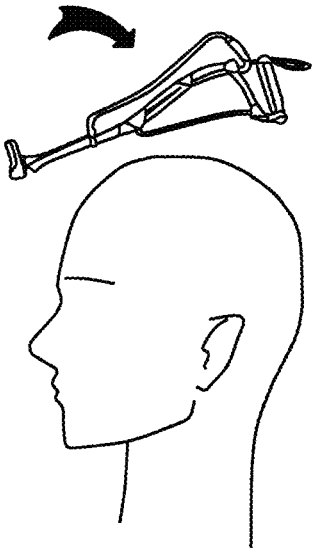
FIGS. 10, 11 and 12 illustrate the establishment on the head of a patient of the headlamp according to the second embodiment, and the almost instantaneous adjustment of its balancing device.
Figure 11:
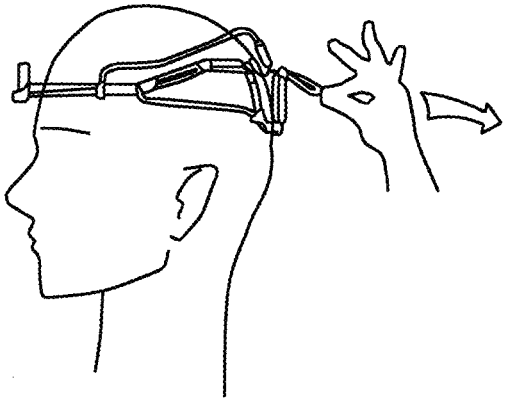
Figure 12:
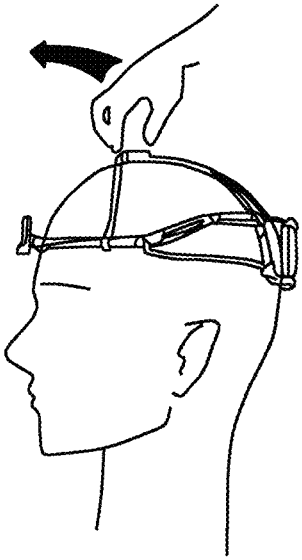

FIGS. 10, 11 and 12 illustrate how one user can, thanks to the invention, locate the headlamp over his head and achieve the adjustment of the headband by setting the sliding element 400 with only one hand.

One thus obtains a quite convenient method for adjusting the headlamp.

Figure 13:
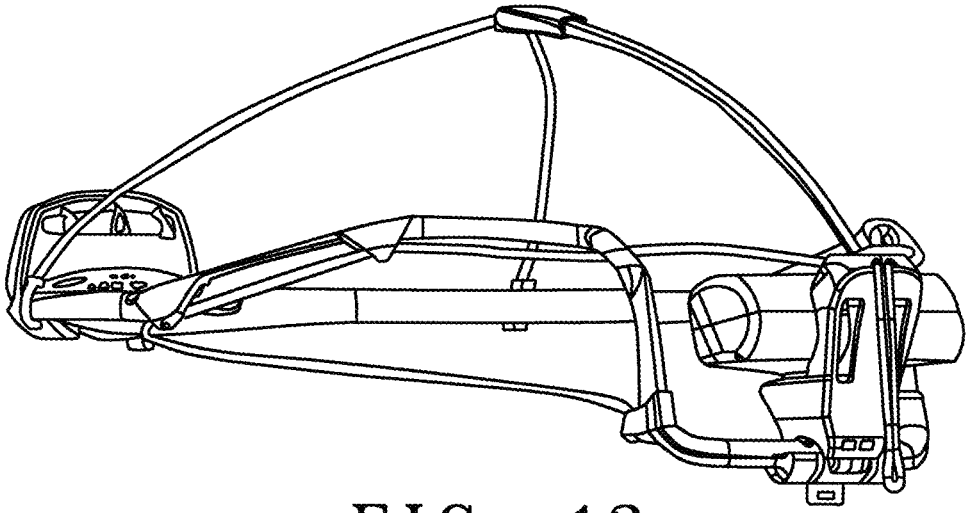
FIG. 13 is a rear perspective view of a third embodiment of a headlamp equipped with a load-balancing device having attachment points at the rear, for example coming to be positioned on the rear battery.

FIG. 13 illustrates a third embodiment wherein one coincides fixing points B and B' on the battery pack 130, which is situated at the rear of the headlamp. Alternatively, one may arrange such situation even without the presence of any battery at the rear, when the headlamp includes, for instance, a remote battery pack situated elsewhere. In this case, the attachment points will be advantageously situated at appropriate fixing points at the rear of the headband structure.

Figure 14:
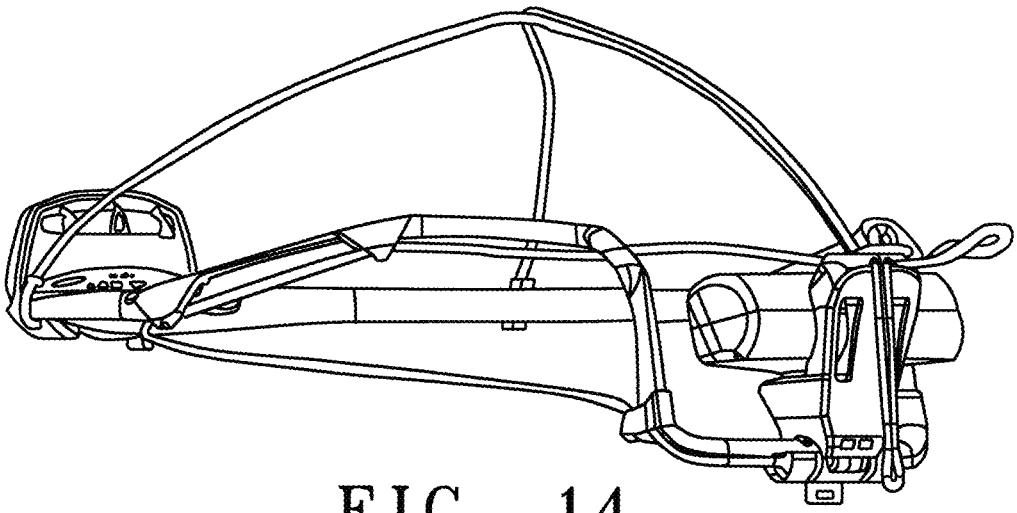
FIG. 14 illustrates a fourth embodiment of a balancing device positioned on the strip, having set points and attachment points on the back of the battery.

In the configuration of FIG. 14, illustrating a fourth embodiment, the load balancing device comprises a attachment point located at the rear, which is based on a "tanka" which usually serves for the adjustment of the headband. In this configuration, the sliding element 400 may be replaced by a sewing, as shown in the illustrative example of figures and 16B, and it is the same "tanka" which allows both the adjustment of the headband and that of the load balancing device. One may thus also obtain a obtain a balancing of the loads in quite a simple manner, without having to use the sliding element 400.

Figure 15A:
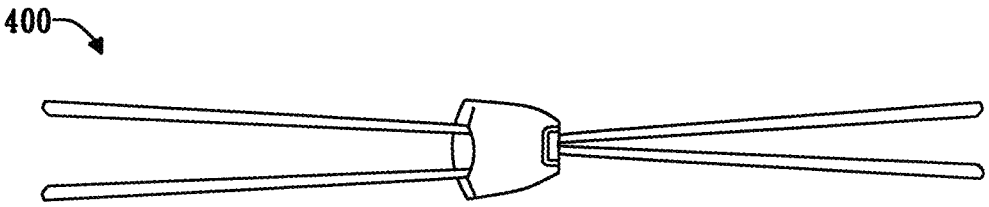
FIGS. 15A to 15C illustrate three respective variants of the sliding element 400.
Figure 15B:
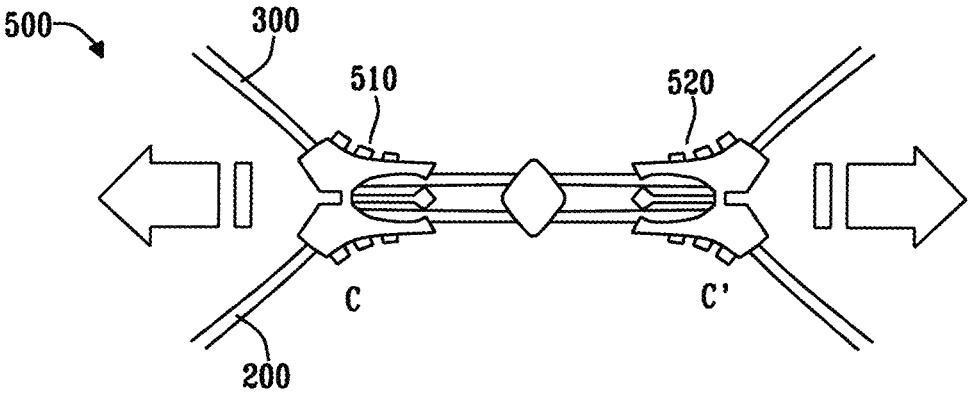
Figure 15C:
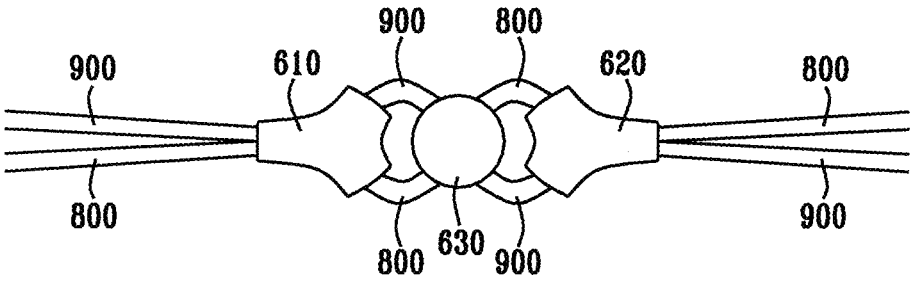

FIGS. 15A to 15C illustrate three different variants of the sliding element 400.

FIG. 15A recalls the preferred embodiment of sliding element 400, which is the embodiment which has been described with respect to the preceding drawings.

FIG. 15 illustrates a second variant wherein a sliding element 500 comprises two independent sliders, based on two parts 510 and 520 respectively left and right, wherein the two strands 200 and 300 are respectively thread up. Each part 510 and 520 could thus slide along one of the two strands, so as to embody two junction points C and C'. Such arrangement shows to be particularly advantageous when the attachment points located at the rear of the structure are particularly remote to each other, as illustrated in the second embodiment of FIGS. 8A-8E, since the adjustment of the device becomes possible by independently sliding each of parts 510 and 520. With the consequence of two possibilities of adjustments, at the front and also at the rear, with an "triangle opening" both at the front and at the rear. Furthermore, preferably, the dual slider which is composed by parts 510 and 520 is realized with a deformable plastic material, with the result of obtaining two sliders being deformable thanks to the tension exerted by strands 200 and 300. This thus facilitates the clamping of the load balancing device thanks to the friction on the deformable parts 510 and 520. So, with this provision, it is not necessary to provide a specific tightening/locking mechanism of the strands 200 and 300, as could be the case in the configuration of FIG. 15A.

In the third variant of FIG. 15C, the slide element comprises three distinct in deformable parts, namely a left element 610, an element 620, and a right element 630, to cause changes in significant direction of each of the two strands 800 and 900 used to connect the attachment points A, A', B and B' on the headband. Thus, one obtains a crossing of links and a fairly important friction allowing the device to be clamped on the user's head.

Figure 16A:
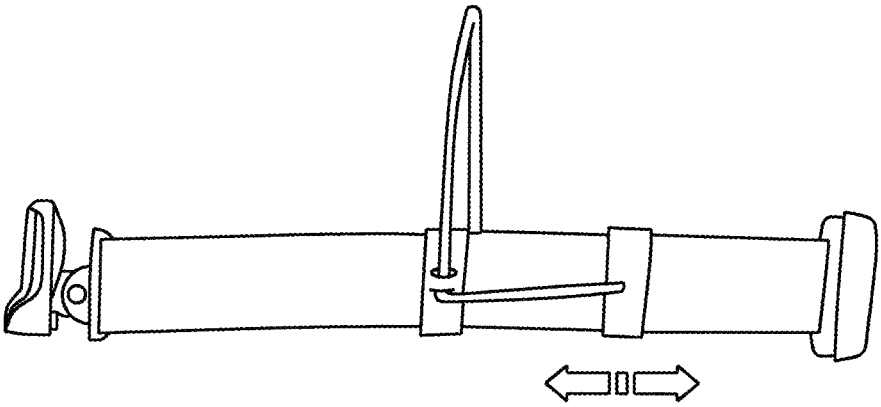
FIGS. 16A and 16B illustrate a fifth embodiment of a headlamp with its balancing device, having attachment points A and A' with sliders.
Figure 16B:
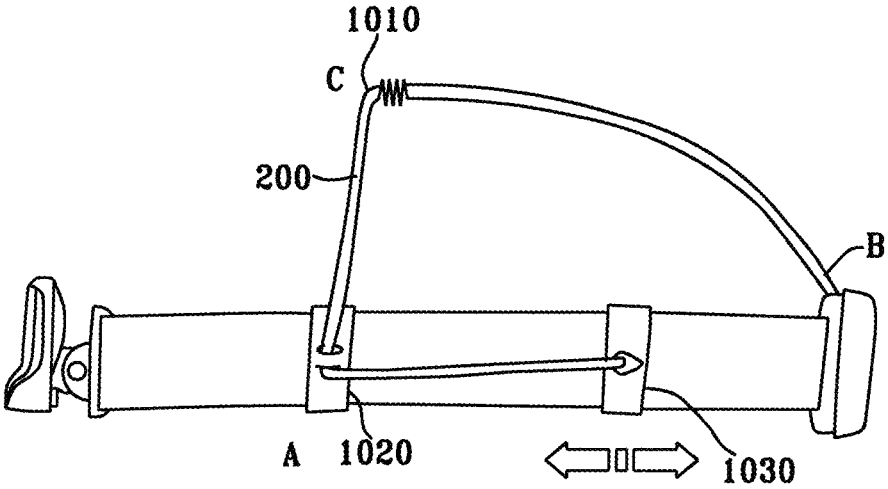

Finally, FIGS. 16A and 16B illustrate a fifth embodiment of a load balancing device in which instead of the slider 400 present on both strands 200 and 300—only strand 200 being shown in FIG. 16B—A seam 1010 for connecting the two strands 200 and 300 at a fixed point C. The point of attachment A is embodied, in this embodiment, by a textile disposed on the headband having a loop 1020 in which comes slipping the strand 200 to then go to join a fixation on a sliding element 1030 positioned on the headband. Thanks to this configuration, one obtains a possibility of simple adjustment and nevertheless effective.

What is claimed is:

1. A headlamp comprising:

a headband comprising a front section, a rear section, a right branch and a left branch;

a light source located at the front section of said headband;

wherein said headlamp further comprises a load balancing device configured to be fixed on said right and left branches and said rear section, said load balancing device comprising two strands including:

a first strand comprising a first end (A) and a second end (B) respectively attached on one left front fixing point of said left branch and one left rear fixing point of said rear section of said headband;

a second strand comprising a first end (A') and a second end (B') respectively attached on one right front fixing point of said right branch and one right rear fixing point of said rear section of said headband;

one element wherein said first and second strands are thread up so as to bring closer the two strands at one common point C wherein the headband is a structure having a constant length, and being symmetrical with respect to a median sagittal plane, and further comprising an alteration of rigid/semi-rigid elements so as to allow a deformation in a space and an adjustment on the head of a user.

2. The headlamp of claim 1 further comprising a battery located at said rear section of said headband, and wherein said element is a sliding element;

wherein said first and second strands are thread up inside said sliding element so as to bring closer the two strands at said point C.

3. The headlamp of claim 2, further comprising a first and a second sliding element which both slide along said first and second strands whereby the possibilities of adjustment of said load balancing device are twice.

4. The headlamp of claim 1 wherein the fixing points are made of movable fixing elements, wherein said movable fixing elements comprise movable clips.

5. The headlamp of claim 1 wherein the first ends of said first and second strands are fastened via a sliding element so as to move the position of points on the right and left branches of said headband.

6. The headlamp of claim 1 wherein the second ends of said first and second strands are located at one common fixing point situated close to the battery at the rear section of the headband.

7. The headlamp of claim 1 wherein the fixing elements are movable, wherein a movable action is clipping.

8. The headlamp of claim 1 wherein the headband comprises:

a rigid/semi-rigid front section allowing a certain deformability along a first plane (x, y);

a rigid/semi-rigid intermediate section allowing a certain deformability along a second plane (x, z);

a rigid/semi-rigid rear section allowing a certain deformability along a third plane (y, z);

wherein said headband comprises elements configured for the attachment and the passage of an elastic link for constraining the deformation of the rigid/semi rigid headband within the three planes.

9. The headlamp according to claim 1 wherein said headband comprises:

a front section comprising a first semi-rigid element;

a rear section comprising a rigid or semi-rigid element;

a left branch comprising:

a first rigid element having a first lower end and a second upper end; wherein said first rigid element has a higher rigidity than that of said front section or rear section;

wherein the first end of said first rigid element is fixed to a first end of the front section, wherein said first rigid element comprises at its two lower and upper ends, respectively, a first and a second traversing hole configured to receive a first tightening elastic link;

a second semi-rigid element having a first end and a second end, wherein said first end of said second semi-rigid element is fixed at the second end of said first rigid element;

a third rigid element having a first end and a second end, and comprising a traversing hole configured to receive said first elastic link coming from the second traversing hole of said first element;

wherein said first end of said third element is fixed at the second end of said second element;

a fourth semi-rigid element having a first end and a second end, wherein the first end of said fourth element is fixed at the second end of said third element;

a fifth rigid element having a first end and a second end, wherein the first end of said fifth element is fixed at the second end of said fourth element, wherein the second end of said fifth element is fixed at the first end of the rear section;

wherein said fifth element allows the fixing of the elastic link coming from the first passage hole of said first element;

a right branch comprising:

a sixth rigid element having a first lower end and a second upper end, wherein said sixth rigid element has a rigidity which is higher than that of said front section or rear section, wherein the first end of said sixth element is fixed to a second end of said front section, said sixth element comprising, respectively at its two lower and upper ends, a first and a second traversing holes configured to receive a second elastic link;

a seventh semi rigid element having a first end and a second end, wherein said first end of said seventh element is fixed to the second end of said sixth element;

a eighth rigid element having a first end and a second end and comprising a traversing hole configured to receive said second elastic link coming from the second traversing hole of said sixth element;

wherein the first end of said eight element is fixed to the second end of said seventh element;

a ninth semi rigid element having a first end and a second end;

wherein the first end of said ninth element is fixed to the second end of said eight element;

a tenth rigid element having a first end and a second end;

wherein the first end of said tenth element is fixed to the second end of said ninth element;

wherein the second end of said tenth element is fixed to a second end of the rear section;

wherein said tenth element allows the fixing of the second elastic link coming from the first traversing hole of said sixth element.

10. The headlamp of claim 1 wherein said headlamp is configured for allowing the fixing of said first and/or said second ends to said first and second strands at diverse positions of the headband.

11. A headlamp according to claim 1 wherein a battery is located at the rear section of said headband.

* * * * *